United States Patent [19]

Ramsauer

[11] Patent Number: 5,039,143

[45] Date of Patent: Aug. 13, 1991

[54] BAR CLOSURE WITH BAR-SUPPORTED DOUBLE ROLL LOCKING PIN

[76] Inventor: Dieter Ramsauer, Am Neuhauskothen 20, Velbert, Fed. Rep. of Germany

[21] Appl. No.: 214,740

[22] PCT Filed: Sep. 12, 1987

[86] PCT No.: PCT/DE87/00414

§ 371 Date: May 25, 1988

§ 102(e) Date: May 25, 1988

[30] Foreign Application Priority Data

Sep. 25, 1986 [DE] Fed. Rep. of Germany ..... 86113174

[51] Int. Cl.[5] ..... E05C 9/12

[52] U.S. Cl. ..... 292/39; 292/DIG. 68; 292/160

[58] Field of Search ..... 292/32, 33, 34, 39, 292/40, 142, 143, DIG. 53, DIG. 64, DIG. 68, DIG. 32, 68, 91, 56, 58, 116, 156, 160

[56] References Cited

U.S. PATENT DOCUMENTS

| | | | |
|---|---|---|---|
| 1,671,328 | 5/1928 | Sturm et al. | 292/DIG. 68 X |
| 1,729,039 | 9/1929 | French | 292/DIG. 68 X |
| 2,147,903 | 2/1939 | Kaser | 292/DIG. 68 X |
| 2,158,336 | 5/1939 | Madland | 292/DIG. 32 X |
| 2,370,841 | 3/1945 | Chervenka | 292/91 X |
| 2,498,508 | 2/1950 | Rudolph | 292/DIG. 68 X |
| 2,518,141 | 8/1950 | Hiler | 292/DIG. 68 X |
| 3,744,831 | 7/1973 | Joseph et al. | 292/DIG. 68 X |
| 4,385,423 | 5/1983 | Vermilye | 292/68 X |
| 4,533,165 | 8/1985 | Edelman | 292/68 |
| 4,848,811 | 7/1989 | Laufenburg et al. | 292/16 |

FOREIGN PATENT DOCUMENTS

| | | | |
|---|---|---|---|
| 0176890 | 4/1986 | European Pat. Off. . | |
| 2417101 | 10/1975 | Fed. Rep. of Germany | 292/142 |
| 7719672 | 10/1977 | Fed. Rep. of Germany . | |
| 8406483 | 6/1984 | Fed. Rep. of Germany . | |
| 3300423 | 7/1984 | Fed. Rep. of Germany | 292/39 |
| 1476111 | 2/1967 | France | 292/68 |
| 2156896 | 10/1985 | United Kingdom | 292/39 |

*Primary Examiner*—Eric K. Nicholson
*Attorney, Agent, or Firm*—Darby & Darby

[57] ABSTRACT

A bar closure for installation in the fillet gas of sheet metal cabinet doors, the closure including a lock with an actuating device led through the door panel to the outside such as a handle, pivot handle, key or the like. The actuating device has at least one bar extending parallel to the door edge in the fillet gap or the like consisting of flat strip material. The bar stands upright on the door panel and is supported on at least one site outside the lock displaceable longitudinally with guide elements that have a corresponding cross section and at least one holding element located on the door frame for receiving the bar forming the lock for the door in its closed postions. The holding element consists of a U-section trestle, which with its U-section web is fastened on the frame in such a way that the bar section extends between the legs of the U-section, and that the legs of the U of the trestle have cuts opening in one of the axial directions of the bar for receiving locking pins carried by the bar forming the lock assembly.

21 Claims, 5 Drawing Sheets

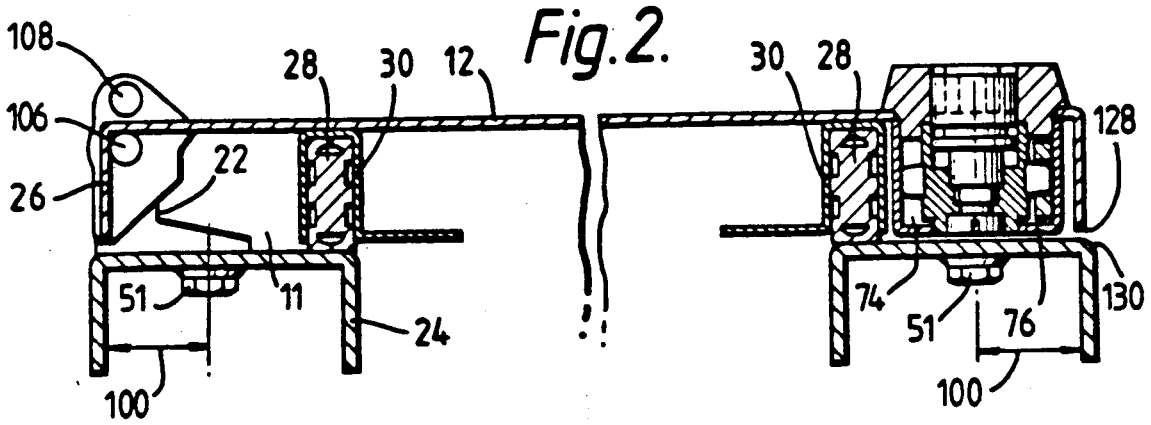
Fig. 2.
Fig. 4.
Fig. 5.
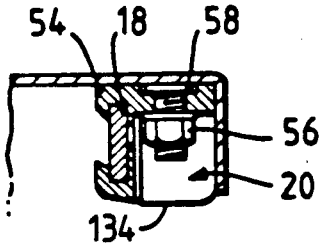
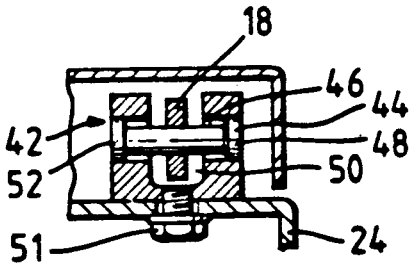
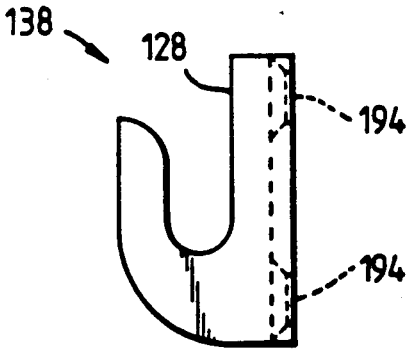
Fig. 9A
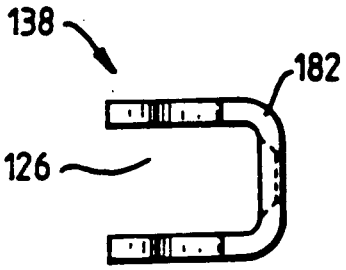
Fig. 9B
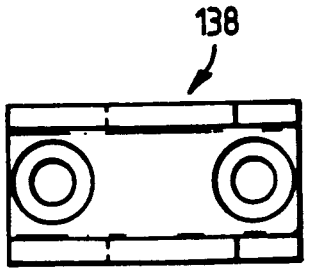
Fig. 9C

BAR CLOSURE WITH BAR-SUPPORTED DOUBLE ROLL LOCKING PIN

BACKGROUND OF THE INVENTION

1. Field of the Invention

The invention relates to a bar closure for installation in the fillet gap of sheet metal cabinet doors.

2. Prior Art

Bar closures consisting of flat strip material, for installation in the fillet gap of sheet metal cabinet doors which are supported longitudinally displaceable on the door panel outside of the lock, are known from the European patent number 0176890. Sheet metal cabinets with leaf shaped doors have limited stability. These doors have high closing requirements because they are provided with an angle bent edge forming the fillet gap. Such cabinet doors can potentially warp, twist and sometimes are subjected to particularly high stresses. If these are doors of electrical switch cabinets containing high-voltage switches, arcing can occur within the cabinet which leads to the explosive release of arc gases. This subjects the door to high pressure.

Therefore, it is important to form bar closures for leaf shaped sheet metal cabinets in a way that the door is securely connected to the body of the cabinet so that the door can also absorb the described loads. This means in the case of tall switch cabinets locking at three points of the door the region of the closure as well as at the upper and at the lower end as is the case with most bar closures, the locking elements formed by the lock itself as well as by the bar ends is sufficient. If additional locking points are provided, they must be arranged in the central region of the bar, which creates diverse problems. For one, it is difficult to make the arrangement in such a way that the bars remain axisymmetrical. Such axial symmetry, however, has the advantage that it ensures exchangability of the bars, which is extremely important for cost-effective production and simple installation. Another problem is that some locking means place a uni-lateral load on the flat strip bars causing tilting which is detrimental to their operation. Changes in the known bar closure structures are only possible to a limited extent should changes become necessary due to moving a cabinet, changing the closing conditions or the like.

Problems of warping are particularly grave for bars consisting of flat strip material. On the other hand, such flat strip bars are important for switch cabinets with sheet metal doors having a fillet gap because they utilize the otherwise dead space in the bent region and do not occupy utilizable space within the switch cabinet. In addition, this arrangement has the advantage that the closure is outside the switch cabinet sealing area. Therefore, apertures required for the bar closure do not need to be included under the sealing measures. This saves sealing material, simplifies the installation, and decreases the danger of sealing breakdown that occurs under some operating applications.

SUMMARY OF THE INVENTION

The invention improves on the bar closure described above by using symmetrically structured flat strip bars without relinquishing the locking points over the length of the bar and without impairing ease of running or increasing the danger that the closure will unintentionally open when exposed to shaking. Moreover, it should be possible to change the bar closure from a right-closing door into a left-closing door without any problems.

This is solved by a holding element located on the door frame consisting of a U-section trestle which is fastened to its U-section web on the frame so that the bar section extends between the legs of the U section. Also, the legs of the U of the trestle have cuts opening in one of the axial directions of the bar to receive locking pins carried by the bar.

These measures permit the bar to be symmetrical and the arrangement to have a large number of locking points on the bar. However, the bar closure remains a simple structure and therefore inexpensive to produce and easy to install.

One embodiment has double roll pins carried by the bar as locking pins. These pins are formed by rigidly leading a bearing bolt R pin through the bar section on the center axis of the bar. This bolt or pin holds one roller rotatably on each side of the bar section. This arrangement runs extremely smoothly and is low-warping.

Another advantage of the invention is that the construction permits models with additional improvements. The U-section trestles can function as stops for the door when closing it prior to locking. This makes stopping devices superfluous and prevents damage to the door coating, because stopping would otherwise occur by placing the door edge on the door frame. (This is the case with ventilated doors without sealing). With a trestle of the present invention, an embodiment is therefore possible that is extraordinarily stable and prevents bending the hook open even with a large load that may occur in switch cabinets for mixed low and high-voltage devices through arc gases. Until now, such cabinets containing both low and high-voltage devices had to be provided with very expensive locking devices.

Due to symmetry in the invention, warping effects on the flat strip bar are avoided, which permits a very low-friction bearing. This permits operation of the closure with very small forces. Finally, the construction permits construction of a door panel that is largely or completely symmetrical with respect to the fastening holes for the bar fastening means and the joint hinge arranged on the other side.

BRIEF DESCRIPTION OF THE DRAWINGS

The invention will be explained in greater detail in conjunction with embodiments, represented in the drawings, in which

FIG. 2 shows an axial sectional view along line 2—2 of FIG. 1;

FIG. 4 shows a sectional view along line 4—4 of FIG. 1;

FIG. 5 shows a sectional view along line 5—5 of FIG. 1;

FIGS. 9A–C show top, front and right side elevational views respectively of another embodiment of a closure hook as part in a representation similar to that of FIGS. 7A–C and 8A–C.

DETAILED DESCRIPTION OF THE PREFERRED EMBODIMENT

Figure 1:
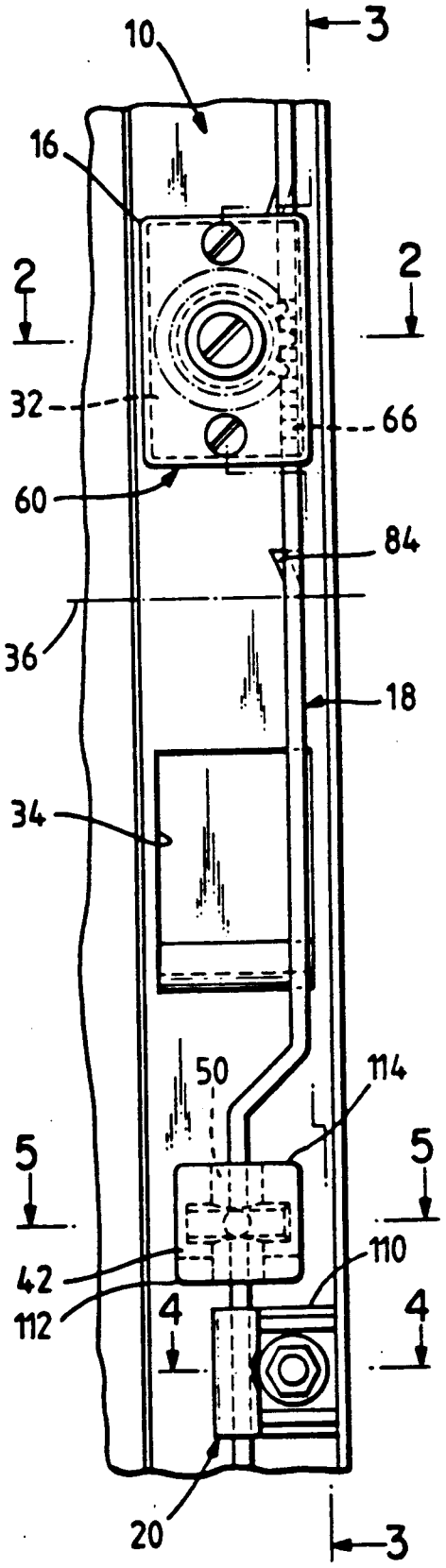
FIG. 1 shows the fillet gap of a sheet metal cabinet door with a bar closure installed in this fillet gap with roll pins and holding elements according to a first embodiment of the invention as viewed from behind.

FIG. 1 shows a view of the fillet gap 10 of a sheet metal door 12. A bar closure 14 is arranged in this space. The bar closure 14 includes a lock 16, from which a bar 18 extends in the fillet gap 10. The bar 18 is supported within the lock 16 and displaceably on the door panel 12 within a bar bearing 20. FIG. 2 shows that the sheet metal cabinet door 12 is articulated with joint hinges 22 to the body of the cabinet 24, which takes advantage of the other fillet gap 11. This gap is formed between the turned over outer edge 26 and a section sheet 30 welded onto the door panel and holds a sealing 28. In sheet metal cabinets with such fillet gaps 10, 11, a rectangular aperture 32 or 34 is arranged in the fillet gap for the closure; if sinkable pivot lever closures are intended to be used these are two rectangular apertures 32 and 34 arranged symmetrically to the horizontal door center 36.

Figure 3:
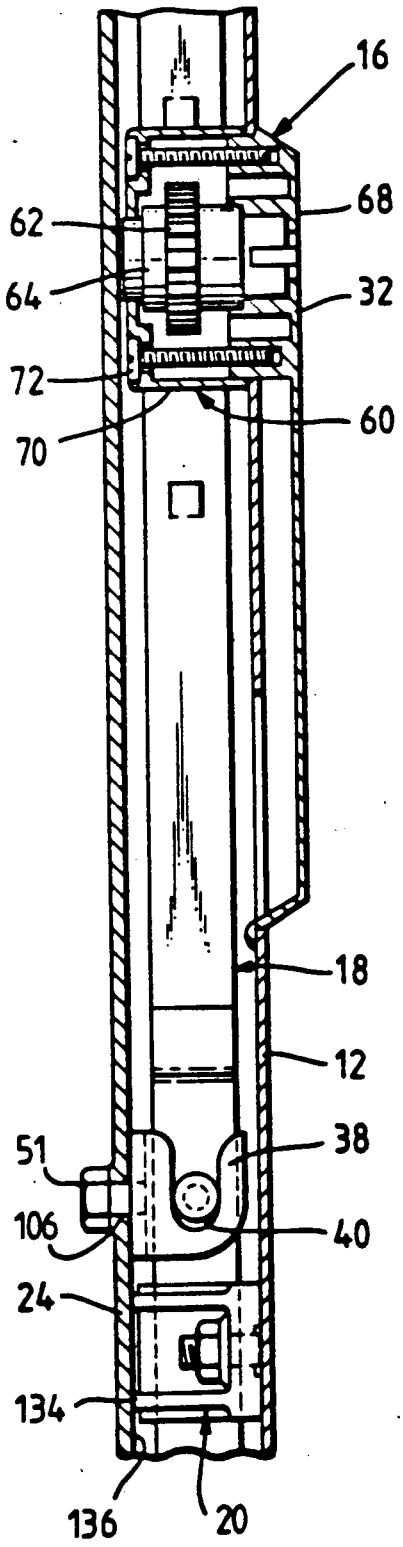
FIG. 3 shows an axial sectional view along line 3—3 of FIG. 1.

As can be seen in FIG. 3, which is an axial sectional view along line B—B of FIG. 1, a hook-like projection 38 is located on the body of the cabinet 24. The hook-like projection 38 is penetrated by a double roll pin 40 carried by the closure bar 18 when closing the bar closure to form a locking assembly 42. FIG. 5 is a sectional view C—C through this locking assembly 42. FIG. 5 shows that the bar 18 has a rectangular cross section formed from the flat strip material. This bar carries in press fit a peg 44, which supports bilaterally rotatable rollers 46. The rollers are readily rotatable because of play but cannot slide off the peg 44 due to the presence of a head 48 on the one side of the peg 44 and a flange (beading) 52 on the other side of the peg which is generated on the appropriate side of the peg after completion of installation of peg and rollers. Instead, the rollers can be supported with a retainer ring and can be potentially assembled together with the peg. This is advantageous in that closure bar guides 20 may be used, requiring that the bar be slid through axially.

The hook 38 is provided with a slit 50 to receive the bar 18. As seen in section C—C FIG. 5, the hook has a U-shaped profile with the web of the U having a threaded bore, into which a setscrew 51 can be screwed to fix the hook 38. The hook may include a safeguard against rotation in the form a prismatic aperture in the body of the cabinet 24, into which corresponding projections of the hook may be slid as ensurance against rotation.

A possibility for guiding the bar is shown in section D—D, FIG. 4. Here, the bar guideway is torsion-proof with a stud bolt arrangement in the corner space of the turned over edge space 10. It is formed so that the flat strip bar 18 can be slid into the guideway after a projection or lug 54 has been bent away, whereupon the fastening nut 56 of the welding bolt 58 is tightened. This nut presses the lug 54 against the bar 18, providing a safeguard.

FIG. 3 shows that the lock 32 comprising a lock nut and bar bearing 60, which rotatably holds a lock nut 64 carrying a pinion 62. The lock nut 64 can be rotated with an actuation device such as a handle, pivot lever, socket wrench or similar means led through the door panel 12 to the outside, with the pinion 62 engaging corresponding perforations or denticulations 66 of the bar 18 so as to push it up and down.

The lock nut and bar bearing 60 include a base part 68, in which one end of the lock nut 64 is supported, and a cap part 70, which can be placed on the base part 68. The cap part is fixed with screws 72 to the base part and supports the other end of the nut. As can be seen in the sectional representation A—A of FIG. 2, the lock nut and bar bearing 60 also forms the guide slits 74 and 76 for selecting the bar 18 in either the placement as shown, in which the closing direction is clockwise, or in channel 74, in which the closing direction for the actuating device is reversed.

Figure 10A:
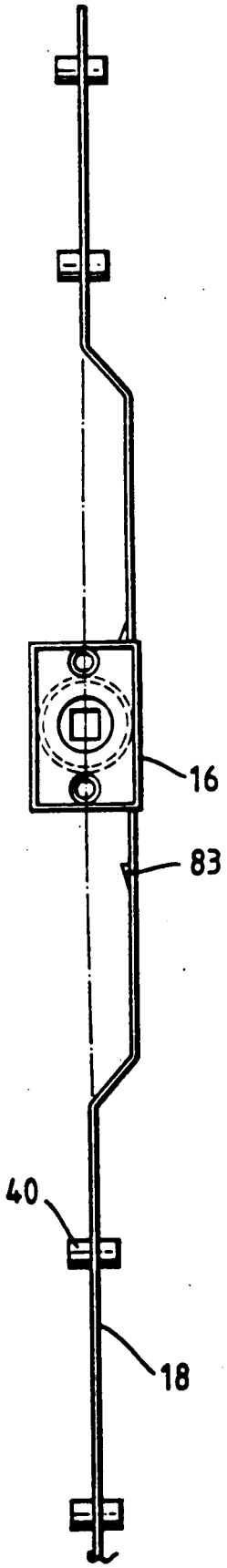
FIGS. 10A–C show left side, front and right side elevational views of the unitary flat strip bar used in FIG. 6 shown in two different lock bearing possibilities.
Figure 10B:
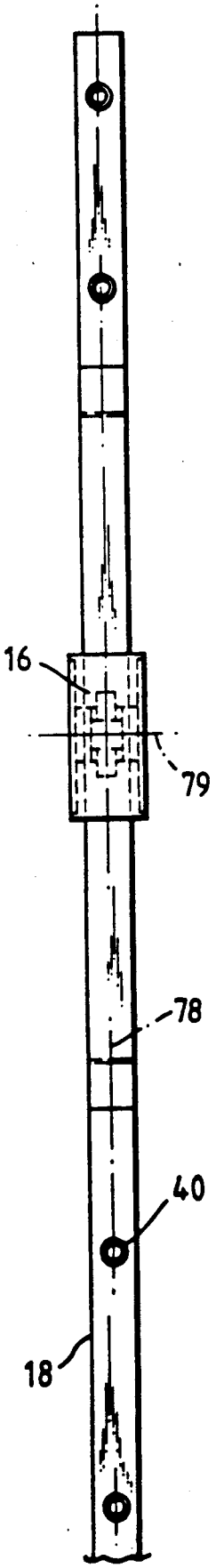
Figure 10C:
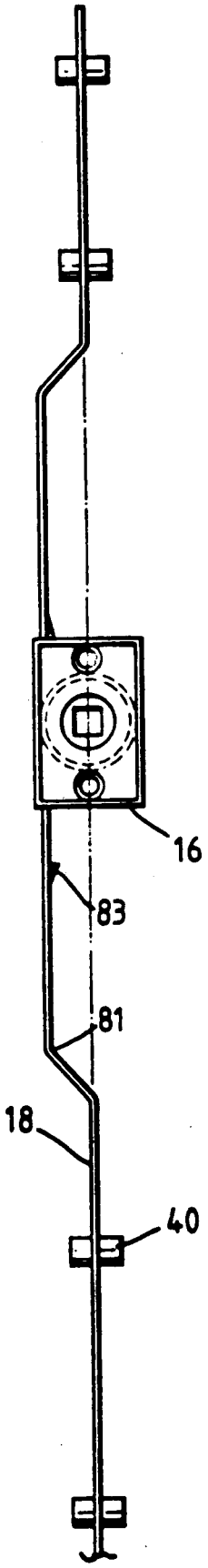

In order to permit this turning of bar 18 and change in the direction of rotation with respect to the actuating device without having to undertake other changes, the bar 18 (see also FIGS. 10–C) is built to have two-fold axisymmetrically specifically around the longitudinal axis 78 and the transverse axis 79. This symmetry extends to the punched out stopping lugs 83, which contact the outer surface of the lock 16, and limit the motion path of the bar. The right angle-bends 82, which yield the free space for the arrangement of the pinion 62, and the bores 86, 88 which are provided to receive the already described double roll pins 40 also limit the motion path of the bar. FIGS. 10A–C show the two described arrangements of the flat strip bar 18 and the installed double roll pins 40.

Figure 6:
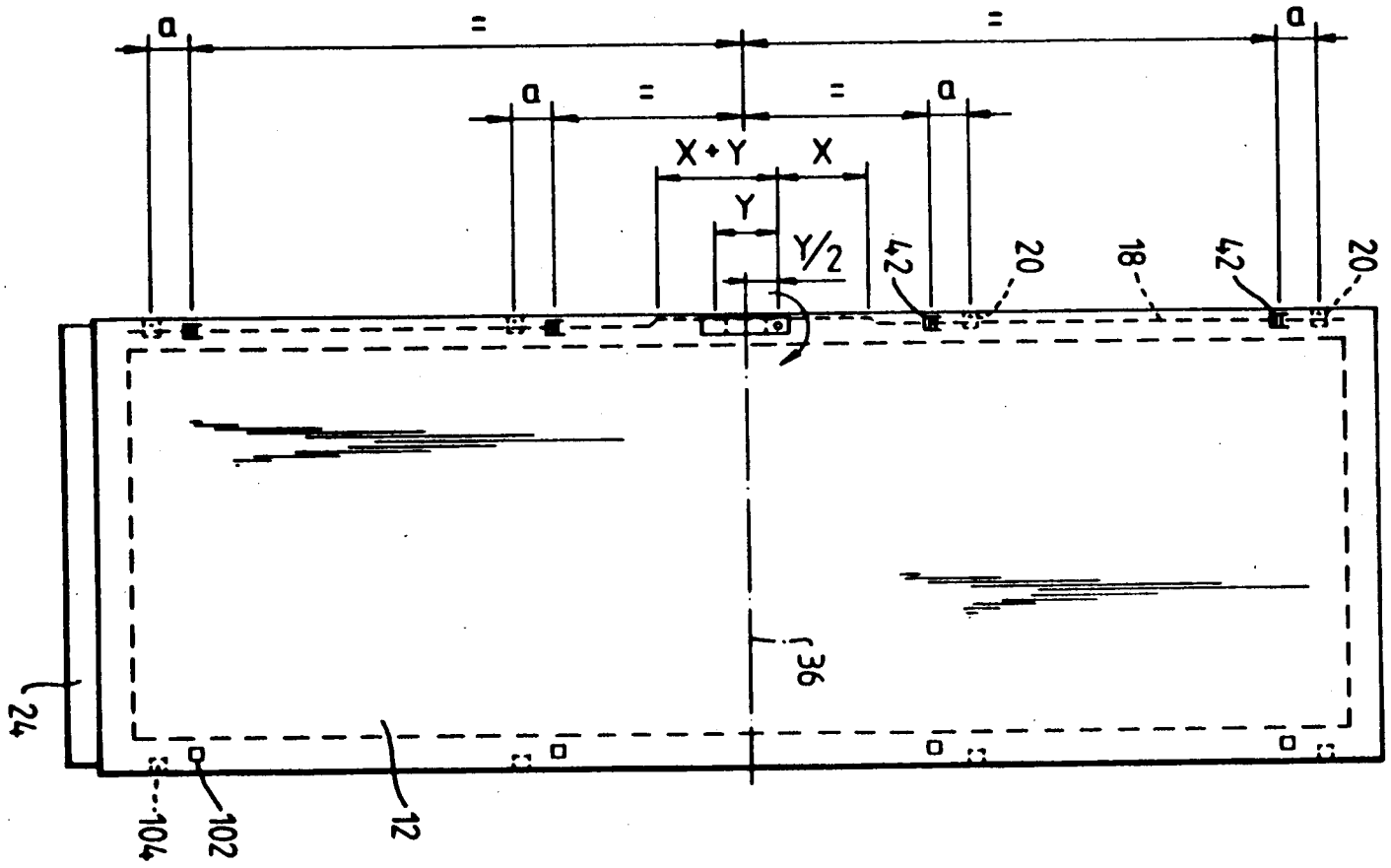
FIG. 6 shows a view of a switch cabinet with a bar closure according to FIGS. 1 to 5.
Figure 7A:
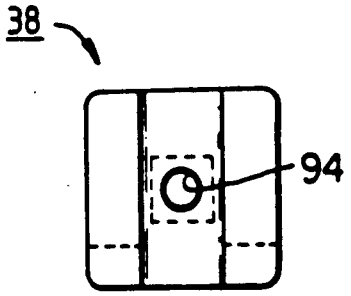
FIGS. 7 A–C show left side, front and bottom views respectively of a component representation of the closure hook according to FIGS. 1 to 5.
Figure 7B:
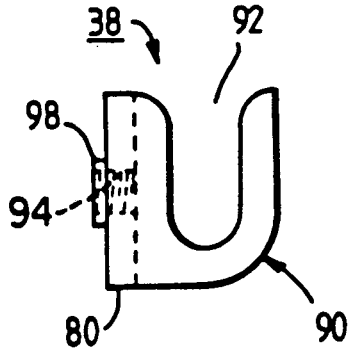
Figure 7C:
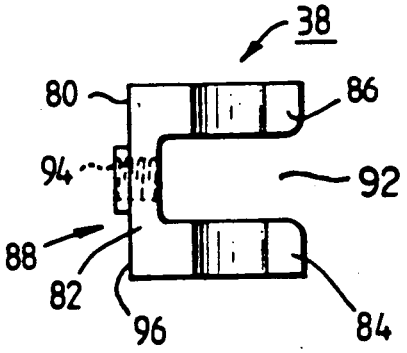

The holding element 38 is located on the door frame, which is preferably near the corresponding bar guides 20 (see FIG. 6). This is done in order to keep the lever arm located between the guide 20 and the locking assembly 42 and to keep the bending load of the flat strip bar 18 of FIGS. 7A–C as small as possible. The holding element 38 includes a trestle with a U profile in two directions. U-section 88 surrounding the bar (see FIG. 7C) is fastened with its U-section web 82 to the door frame (see FIG. 5) so that the bar profile of the flat strip bar extends between the legs 84, 86 of the U-section 88. The legs of the U 84, 86 form a U-section 90, which occurs because the legs of the U of the U-section 88 have cuts 92 opening in the axial direction of bar 12 to receive the rollers 46 and locking them as shown in FIG. 3. The trestle 80 has a threaded bore 94 arranged centrally on the web 82 of the U-section 88 and a polygonal projection 98 encompassing the bore 94 and projecting beyond the outer surface 96 of the U-web. This forms a square projection that secures the trestle 80 in a torsion-proof manner to the body of the cabinet 24 with a screw bolt 51 (see FIG. 5). In order to secure the trestle, the body or door frame 24 has corresponding punch-outs 102 (FIG. 6), with the same cross section as the polygonal projection 98.

As FIG. 6 show, the individual lockings 42 are arranged on the body of the cabinet symmetrically to the horizontal line bisecting the door 36. This has the advantage of using a symmetrical flat strip bar for left-closing as well as for right-closing without changing the arrangement of the welding bolts (or also the arrangement of screw hole apertures) so as to secure the bar guides. Because the bar guide arrangement is symmetrical to the bisecting line, the door panel can be used.

For this reason, fastening holes are provided in the body of the cabinet for the joint hinges 22 which are identical to those for the locking assembly 42. These may be rectangular apertures 102 provided for receiving the projection 98, the center of which has a radial distance 100 to the outer cabinet sheet metal. The corresponding apertures for fastening the joint hinge 22 also have a radial distance 100 (see FIG. 2). This simplifies the installation of a door panel as either a right or a left-closing door. The door panel could have fastening means for the other end 104 of the joint hinge near the prismatic aperture to fasten the joint hinge on the body 102 of the cabinet. Alternatively, a fastening for the joint hinge part for the door panel with setscrew 106 is as shown in FIG. 2. The center of rotation 108 of the joint hinge lies so the cabinet door can be opened 180° even if the cabinets are set up in rows.

Arranging the bar guide 20 and the locking 42 near each other has another advantage that, if necessary, the structural parts serving as a bar guide (shown in FIG. 1 and FIG. 4) can have a contact surface 110 having a locking assembly 42 formed as hook 38. The structural parts come in contact with another contact surface 112 (see FIG. 1) formed by hook 38, when the door is closed (in FIG. 1, however, a distance is maintained). In this case, the hook 38 is clamped between the roll pin 40 and the surface 110 of the bar guide 20. This creates a tight securement which prevents it from warping and canting, particularly during strong pressure load on the sheet metal door, and thereby also prevents leakage if this is a door with sealing device. This has an advantage in the event that an explosive arc discharges within a high-voltage part of the switch cabinet. The locking 42 can also have a contact surface 114 on the other side (see FIG. 1) in order to be able to use bar guide 20 arranged on this side as support, which would be the case in the upper half of the switch cabinet door shown in FIG. 6.

Figure 8A:
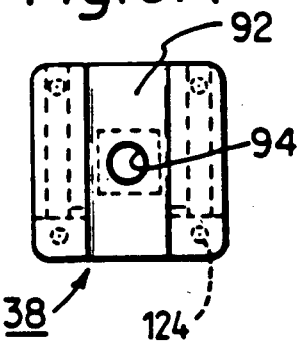
FIGS. 8 A–C show left side, front and bottom views respectively of another embodiment of the closure hook in a representation similar to FIGS. 7A–C.
Figure 8B:
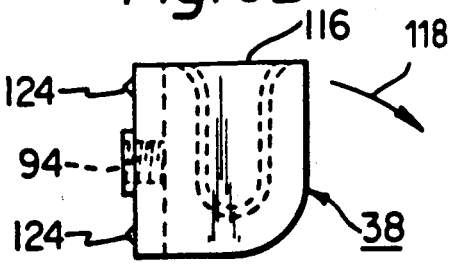
Figure 8C:
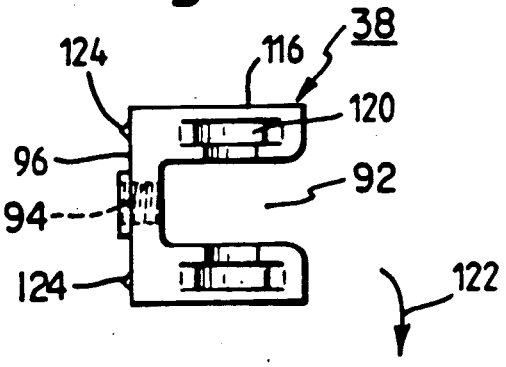

In order to make hook 38 even more stable and to safeguard against bending open under strong load, this hook can be further developed according to FIGS. 8A–C. Here, the cut 92 is not continuous but a web 116 remains, which safeguards the normally free end of the hook against bending open in the direction of arrow 118. The same double roll pins can be used, which are represented in FIG. 1, 2 and 5, if the web 116 is supplemented. However, the cut can narrow toward the center of the bottom forming an undercut 120, into which a specially formed pin or double roll pin with greater outer diameter can be inserted. This construction provides further safeguarding against bending open in the direction of arrow 122.

The representation of FIGS. 8A–C show small projections 124 extending from the outer surface 96, which can effect safeguarding against rotation when used in conjunction with or instead of the projecting square 98.

FIGS. 9A–C show yet another different embodiment of hook 138 which is punched out of sheet metal and equipped with two fastening holes 194 as safety device against rotation. These fastening holes 194 are sunk so that a flat-head screw used for fastening does not project into the space occupied by the flat strip bar within the U-section 126. The web region 182 of hook 138 is extended in the direction of the hook opening and forms a contact surface 128 for the double roll pin 40 when in the unlocked position. In this case, other stopping devices for the door panel with respect to the door frame become superfluous. Such stopping devices prevent the sheet metal edge 128 from resting on the outer surface 130 of the body of the cabinet 24. If the operation takes place by seal 28, scratching of the lacquer is prevented.

This contact surface can also be formed by the bar guide 20. FIG. 3 makes obvious where the front face 134 of the bar guide 20 rests on the outer surface 136 of the body of the cabinet 24.

In the case of a continuous bar, as shown in FIGS. 10A–C, or with bars extending in the same direction all hooks will be oriented in one direction so that the hooks are preferably open in the upward direction. This allows the weight of the bar to cause it to lie in the hook.

It is also possible to use two bars in an opposite actuation direction. The lower half of the door panel is provided with a hook arrangement, in which the hooks are open toward the center (hence upward). This achieves better distribution of the pressure forces created by the penetration of the double roll pin into the hook. This greatly reduces the load on the hinge devices of the sheet metal door and the door panel itself.

In the embodiment with the stop formed by the hook, the advantage is that the size of the cut 92 need only be slightly larger than the diameter of the double roll pins running into it. For reasons of technology of production, only a tolerance of approximately 0.3 to 0.5 mm is required. Without this stopping effect, greater play must be provided.

The positioning of the actuating device (for example, sinkable pivot lever) should be so adapted to the position of the bar 18 so that when the bar closure is in the closed resting position, the double roll pin center is aligned precisely with the center of the fastening screw 51 according to FIG. 3. In that case, the proper closing position is always achievable, regardless of whether or not the hook is open in the upward or the downward direction.

Bar closures of the described nature are used in the electrical industry for closing switch cabinets made of sheet metal.

I claim:

1. An arrangement, comprising a bar closure for installation in cabinet doors having a frame, said bar closure including at least one elongated bar extending in a longitudinal direction and including at least one holding element fastened to said frame for receiving said bar, said bar carrying a locking element, said bar being displaceable in said longitudinal direction when the door is in a closed position so as to be displaceable between a locked position in which the locking element carried by the bar engages the holding element for locking the door and an unlocked position in which the locking element carried by the bar is free of the holding element to permit opening of the door, said holding element having two U-shaped legs, said bar extending between said legs, said U-shape of said legs opening for receiving said locking element therein for locking the door when the bar is in said locked position.

2. An arrangement as in claim 1, further comprising a plurality of locking elements which include double roll pins extending through said bar.

3. An arrangement as in claim 2, wherein said double roll pins comprise a peg each holding one respective roller rotatably on each side of said bar.

4. An arrangement as in claim 3, wherein said peg has ends and a face, said peg being held in press fit in a bore of said bar, said peg being widened at said ends by a flange on said face, said flange forming a stop to prevent said roller from sliding off.

5. An arrangement as in claim 1, further comprising another locking element carried by said bar and another holding element fastened to said frame, said another locking element engaging said another holding element when said bar is in said locked position and being free of said another locking element when said bar is in said unlocked position.

6. An arrangement as in claim 1, further comprising a projection lug extending from said legs to said bar for increasing friction to said bar.

7. An arrangement as in claim 1, further comprising a plurality of holding elements fastened to said frame, each of said holding elements having legs; and a plurality of locking elements which are fitted into grooves sunk into said legs of said holding elements.

8. An arrangement as in claim 1, wherein the holding element is made of punched-out material.

9. An arrangement as in claim 1, wherein said legs are extended to contact said locking element when said bar is displaced into said unlocked position.

10. An arrangement as in claim 8, further comprising a plurality of holding elements, said holding elements being arranged symmetrically on the door relative to a center line which bisects the door transversely; and a plurality of locking elements carried by said bar, said locking elements engaging respective ones of said holding elements when said bar is in said locked position for locking the door, said locking elements being free of said holding elements when said bar is in said unlocked position.

11. An arrangement as in claim 10, wherein the door has opposing joint hinges, said holding elements being arranged at a level which is the same as that of the opposing joint hinges.

12. An arrangement as in claim 11, further comprising parts made of punched-out material for receiving said hinges.

13. An arrangement as in claim 1, further comprising bar guide elements that are arranged symmetrically with respect to a center line which bisects the door transversely.

14. An arrangement as in claim 13, wherein only one of said guide elements form a contact surface facing said holding element and is arranged in such a way that when the door is closed, a contact surface of said holding element rests against said contact surface of said one guide element.

15. An arrangement as in claim 1, further comprising a plurality of elongated bars held by respective holding elements that are located on said frame, all of said holding elements having legs which point in the same direction.

16. An arrangement as in claim 1, further comprising two bars moving in opposite directions. the holding elements opening in opposite directions relative to each other.

17. An arrangement as in claim 1, wherein said bar closure is installed in a fillet gap of said cabinet doors.

18. An arrangement as in claim 1, wherein said cabinet door is made of sheet metal.

19. An arrangement as in claim 1, wherein said bar is composed of flat sheet metal.

20. An arrangement as in claim 1, in combination with a cabinet door, said cabinet door including a door lock with an actuating device extending through said cabinet door.

21. An arrangement as in claim 1, wherein said bar is supported by a door lock.

* * * * *